US006886367B2

(12) United States Patent
Mitchell et al.

(10) Patent No.: US 6,886,367 B2
(45) Date of Patent: May 3, 2005

(54) CIRCULAR KNITTED GARMENTS HAVING SEAMLESS SHAPED BANDS

(75) Inventors: John C. Mitchell, Asheboro, NC (US); Andrew Ratcliffe, Derbyshire (GB); Chris Williamson, Nottinghamshire (GB)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 10/404,918

(22) Filed: Apr. 1, 2003

(65) Prior Publication Data

US 2004/0198178 A1 Oct. 7, 2004

(51) Int. Cl.[7] ..... A41B 9/00
(52) U.S. Cl. ..... 66/176
(58) Field of Search ..... 66/8, 172 R, 175, 66/196, 197, 171, 176, 177, 169 R, 170; 450/8, 13

(56) References Cited

U.S. PATENT DOCUMENTS

| | | | | | |
|---|---|---|---|---|---|
| 3,537,279 | A | * | 11/1970 | Epley | 66/176 |
| 5,479,791 | A | * | 1/1996 | Osborne | 66/171 |
| 5,553,468 | A | * | 9/1996 | Osborne | 66/171 |
| 5,592,836 | A | * | 1/1997 | Schuster et al. | 66/176 |
| 6,125,664 | A | * | 10/2000 | Browder, Jr. | 66/176 |
| 6,178,781 | B1 | | 1/2001 | Myers | 66/8 |
| 6,178,784 | B1 | * | 1/2001 | Marley, Jr. | 66/173 |
| 6,287,168 | B1 | * | 9/2001 | Rabinowicz | 450/75 |
| 2002/0129434 | A1 | | 9/2002 | Rabinowicz | 2/69 |

* cited by examiner

*Primary Examiner*—Danny Worrell
(74) *Attorney, Agent, or Firm*—Ohlandt, Greeley, Ruggiero & Perle L.L.P.

(57) ABSTRACT

A circularly knitted garment having a body portion and a shaped band is provided. The body portion has a first area defined therein. The shaped band is also defined in the body portion such that a seamless interface is formed between the body portion and the shaped band.

16 Claims, 5 Drawing Sheets

CIRCULAR KNITTED GARMENTS HAVING SEAMLESS SHAPED BANDS

BACKGROUND OF THE INVENTION

1. Field of the Invention

The present invention is related to circular knitted garments. More particularly, the present invention is related to seamless shaped bands for such circular knitted garments.

2. Description of Related Art

Circular knitting processes such as those described in commonly owned and assigned U.S. Pat. No. 6,178,781 to Myers have found wide use in the production of seamless tubular garment blanks. Circular knitting processes can be carried out by commercially available equipment, such as a SANTONI SM8 knitting machine. Seamless tubular garment blanks of this nature can be used in the production of a variety of clothing items, such as pantyhose, stocking, brassiere, blouse, leotard, swimsuit, underwear, and other apparel items.

More particularly, seamless tubular garment blanks have been widely used in the production of garments where seams and other garment discontinuities can be physically and/or aesthetically unpleasing. For example, seams in a brassiere can chaff, exert pressure points and, thus, be a source of physical discomfort. In addition, seams in a brassiere and/or an undergarment can often be visible through an outer layer of clothing, which can be aesthetically unpleasing.

Many seamless tubular garment blanks are provided with a band or welt (hereinafter "band") at one or more edges of the tubular blank. A band is typically a doubled over edge used for ornamentation, reinforcement, supporting the garment on the wearer, or any combination of the foregoing. For example, the band can have elastic properties for supporting the garment on the wearer.

In conventional circular-knitting processes, the bands have been formed at a common height about the circumference of the tubular blank. Here, the band was seamlessly knitted as part of the garment in which the band is a double layer of fabric, where the layers are knitted to one another. The seamlessly knitted band can be more comfortable to the wearer and/or can be more aesthetically pleasing than cut-and-sew garments. However, the constant height bands provided these garments with a distinctive appearance. Namely, finished garments made from prior tubular blanks have a "constant height" or "unshaped" appearance.

The appearance of such prior art tubular blank garments can be contrasted with the appearance of prior art cut-and-sew garments. Cut-and-sew garments are typically made from a plurality of panels, which have been cut to a desired shape and then sewn to one another to form the finished garment. In cut-and-sew garments, the band can be incorporated into the garment in a shaped manner. For example, the band can cut to a desired shape (e.g., varying heights along the circumference of the finished garment) before being incorporated into the finished garment. Alternately, the band can have a constant height along the circumference of the finished garment, but can be sewn into the garment such that other portions of the garment overlap sections of the band when viewed from the exterior of the garment. Both of the aforementioned methods provide cut-and-sew garments with a shaped band, which can be more comfortable to the wearer and/or can be more aesthetically pleasing. Unfortunately, the shaped bands of cut-and-sew garments include seams at the interface of the band and the garment, which can reduce the comfort and appearance of the finished garment.

Thus and until now, garments made from tubular blanks had one appearance (e.g., seamless unshaped bands), while cut-and-sew garments have a second, different appearance (e.g., seamed shaped bands). Accordingly, there is a continuing need for garments made from tubular blanks, which can provide the advantages and/or appearances of the shaped bands available in traditional cut-and-sew garments. Moreover, there is a continuing desire to provide garments having a seamless shaped band.

BRIEF SUMMARY OF THE INVENTION

It is an object of the present invention to provide a circularly knitted garment having a seamless shaped band.

It is another object of the present invention to provide a garment formed from a circularly knitted blank, where the garment has a seamless shaped band.

It is still another object of the present invention to provide seamless shaped bands by overlapping portions of a tubular garment blank with a band of constant height.

It is still another object of the present invention to provide seamless shaped bands by varying the height of the band.

It is a further object of the present invention to provide a tubular or circular knitted blank having a seamless shaped band. The seamless shaped band can be provided with a band of constant height where portions the breast cups overlap portions of the constant height band. Alternately, the seamless shaped band can be provided with a band of varying heights where a combination of stitch structures and/or stitch sizes is used to provide variable band height.

It is still a further object of the present invention to provide a blank having the shaped band benefits available from prior cut-and-sew garments with the seamless band benefits of prior tubular blank garments.

These and other objects are provided by a circularly knitted garment comprising a body portion and a shaped band. The body portion has a first area defined therein. The shaped band is also defined in the body portion such that a seamless interface is formed between the body portion and the shaped band.

A tubular garment blank for use as a brassiere is also provided. The blank comprises a body portion and a shaped band. The body has a pair of breast cups defined therein. The shaped band is also defined in the body portion such that a seamless interface is formed between the body portion and the shaped band.

A circularly knitted brassiere having a main body portion, a shaped band, and a pair of breast cups is also provided. The shaped band is defined at a lower edge of the main body portion such that a seamless interface is provided between the main body portion and the shaped band. The shaped band has a constant dimension between the lower edge and the interface along a circumference of the brassiere. The breast cups are defined in the main body portion. A first portion of each of the pair of breast cups overlaps a second portion of the shaped band. The first and second portions are knitted to one another only at a periphery of the breast cups.

A circularly knitted brassiere having a main body portion, a pair of breast cups, and a shaped band, is also provided. The breast cups are defined in the main body portion. The shaped band is defined at a lower edge of the main body portion such that a seamless interface is provided between the main body portion and the shaped band. The shaped band has a variable dimension between the lower edge and the interface along a circumference of the brassiere.

The above-described objects and other features and advantages of the present invention are appreciated and understood by those skilled in the art from the following detailed description, drawings, and appended claims.

DETAILED DESCRIPTION OF THE INVENTION

Figure 1:
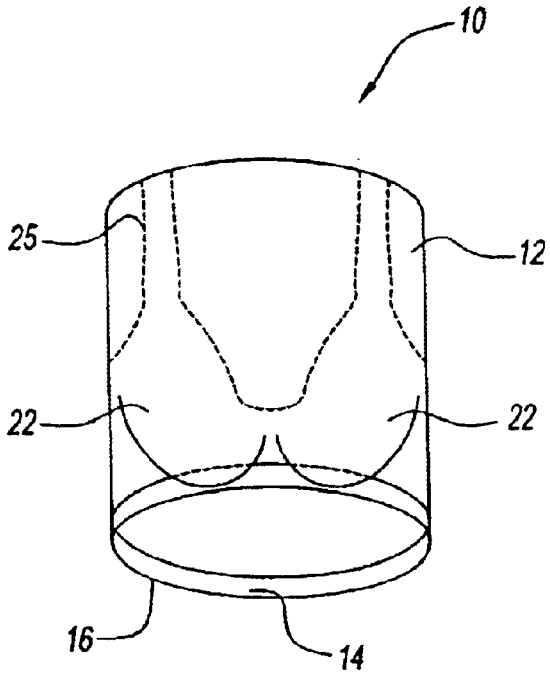
FIG. 1 is a perspective view of a first exemplary embodiment of a tubular blank having a seamless shaped band.

Referring now to the figures and in particular to FIG. 1, a first exemplary embodiment of a tubular or circularly knitted garment blank according to the present invention is generally represented by reference numeral 10. For purposes of clarity only, blank 10 is described herein for use as a brassiere. Of course, blank 10 finds use with many other types of garments.

Figure 2:
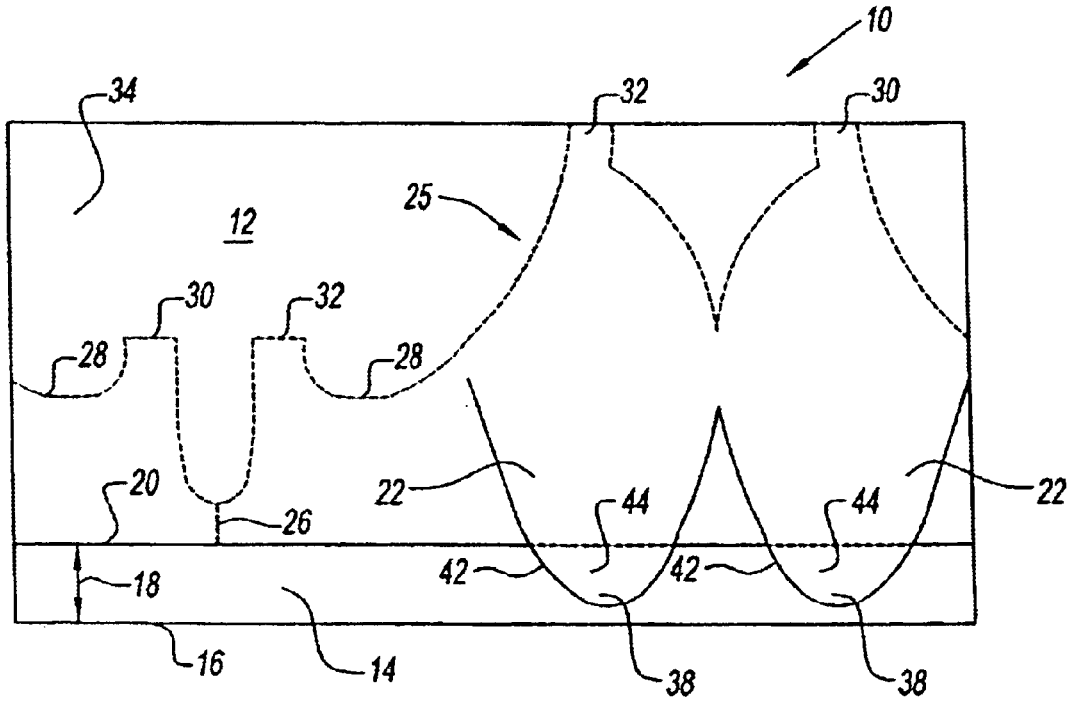
FIG. 2 illustrates a front view of the tubular blank of FIG. 1 laid out along its circumference.
Figure 3:
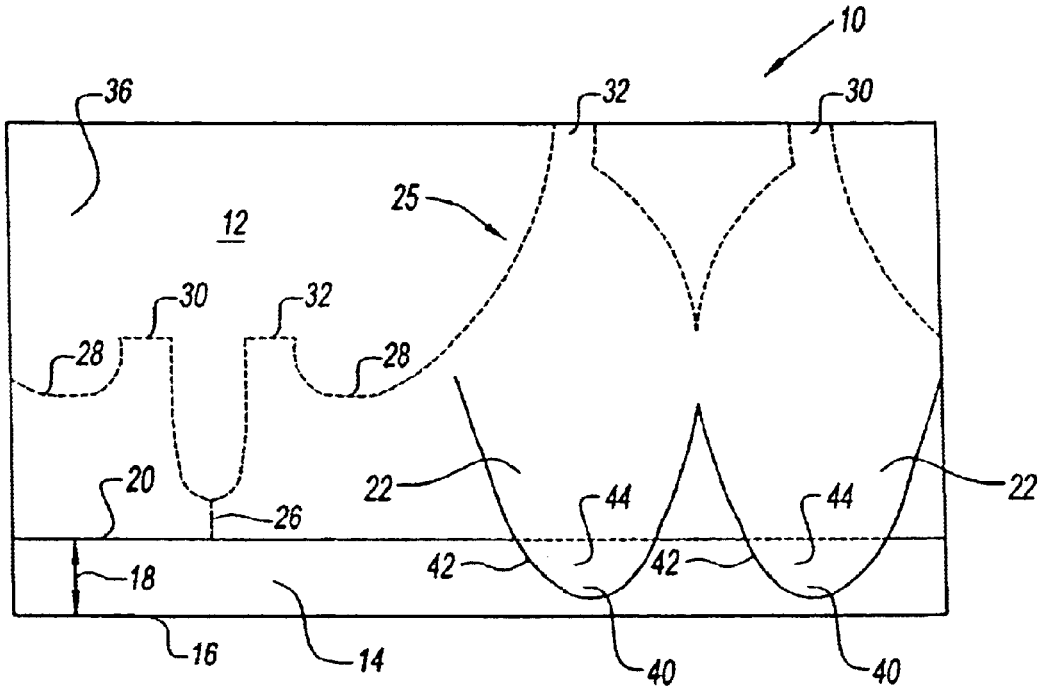
FIG. 3 illustrates a rear view of FIG. 2.

Blank 10 is illustrated laid flat along its circumference in FIGS. 2 and 3. In this embodiment, blank 10 is a brassiere. Brassiere 10 has a main body 12 with a seamless shaped band 14 defined at a lower edge 16 of the main body. Advantageously, band 14 is both seamless and shaped, which has heretofore been unavailable. As used herein, the term "shaped band" is defined as a band that when viewed from the exterior of the garment or garment blank appears to have a varied height along the circumference of the garment or blank.

Band 14 can retain lower edge 16 of brassiere 10 against the torso of a wearer. For example, band 14 can be formed of an elastic material. Band 14 has a height 18 measured from lower edge 16 upwards towards an interface 20 of the band and body 12. Since brassiere 10 is formed using a circular knitted process, band 14 can be incorporated into the brassiere such that interface 20 is a seamless interface.

Blank or brassiere 10 has a pair of breast cups 22 defined in main body 12. Cups 22 can be defined in body 12 through a post-knitting molding operation, a pleat, an extra course of yarn knitted into the breast cups to shape the cups by providing fullness therein, and other conventional knitting structures, such as floating in a yarn or tucking a yarn in selected alternating courses.

Superimposed on blank 10 in a dotted manner is a trim line 25, representing the line for trimming the blank to form the brassiere. For example, line 25 can define a clasp region 26, a pair of underarm regions 28, a set of first strap attachment points or locations 30, and a set of second strap attachment points or locations 32. In order to form the brassiere from blank 10, the blank would be trimmed along line 25. Additionally, a hook and loop type clasp (not shown) would preferably be provided at clasp area 26 and adjustable straps (also not shown) would preferably be provide between each set of attachment points 30, 32, respectively.

It should be recognized that brassiere 10 is illustrated by way of example only as being a strapped brassiere. Of course, blank or brassiere 10 can also be configured to form a strapless brassiere. In this example, trim line 25 would be configured to eliminate strap attachment points 30, 32, and possibly clasp area 26.

The exemplary embodiment of brassiere 10 has an outer surface 34 as illustrated in FIG. 2 and an inner surface 36 as illustrated in FIG. 3. While brassiere 10 is being worn, inner surface 36 is in contact with the user, while outer surface 34 faces away from the user. Outer surface 34 can be embroidered with various decorative designs. Additionally, inner surface 36 can be provided with a soft, comfortable feel.

Brassiere 10 has been configured with band 14 having a constant height 18 along the circumference of the blank. Each breast cup 22 includes a first portion 38 illustrated in FIG. 2 that overlaps band 14 at a second portion 40 illustrated in FIG. 3. First and second portions 38, 40 are knitted to one another only along the outer periphery 42 of cups 22. Namely, the overlapped portions 38, 40 form a semi-circular or semi-parabolic pocket 44. Thus and when looking at outer surface 36 of blank 10, band 14 appears as a shaped band in that cups 22 and band 14 are overlapped in the area of portions 38, 40. Since blank 10 is circularly knitted, band 14 is seamlessly incorporated into the blank and thus includes a seamless interface 20. Accordingly, blank 10 advantageously combines the shaped band benefits available from prior cut-and-sew garments with the seamless band benefits of prior tubular blank garments.

Blank or brassiere 10 can be formed of any desired fabric such as, but not limited to, fabrics made from natural fiber (e.g., cotton, silk), fabrics made from manmade fiber (e.g., NYLON, LYCRA), or any combination of the foregoing.

It should be noted that the circular knitted or tubular blank 10 having shaped band 14 is described herein by way of example only for use as a brassiere. Of course, any final use of the tubular blank having a seamless shaped band is contemplated. For example, tubular blank according to the present invention can find use in garments such as, but not limited to, a pair of pantyhose, a pair of stockings, a blouse, a leotard, a swimsuit, a pair of underwear, a panty, and other apparel garments. In addition, the tubular blanks according to the present invention can also find use in other non-clothing items such as, but not limited to, a medical device such as a constrictive brace for an ankle, a knee, or for providing improved circulation.

Shaped band 14 can be knitted into blank 10 using a typical circular-knitting machine. Circular-knitting machines having a knitting-dial or cylinder. The can include jacks configured to allow loops of the garment to be held. Alternately, the circular knitting machine can use needles that are configured to hold loops of the garment. The jack and/or knitting needles can create band 14 by subsequently releasing the loop back to the knitting process.

Figure 4:
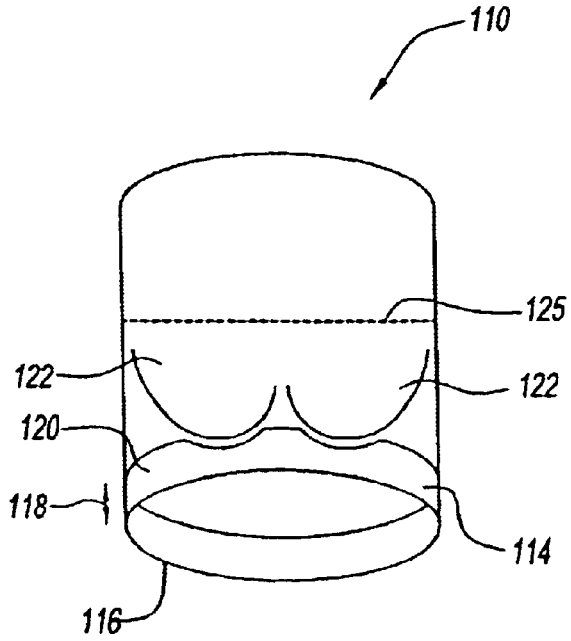
FIG. 4 is a perspective view of a second exemplary embodiment of a tubular blank having a seamless shaped band.

Referring now to FIG. 4, a second exemplary embodiment of a tubular or circularly knitted garment blank 110 is illustrated. Again and for purposes of clarity, blank 110 is described herein for use as a brassiere.

Brassiere 110 is illustrated as a strapless brassiere. Superimposed on blank 110 in a dotted manner is a trim line 125, representing the line for trimming the blank to form the strapless brassiere.

Blank or brassiere 110 includes a seamless shaped band 114 defined along lower edge 116 of main body 112. Blank 110 further includes a pair of breast cups 122 defined in body 112. In the illustrated embodiment, band 114 retains lower edge 116 of brassiere 110 against the torso of a wearer. For example, band 114 can be formed of an elastic material.

Since blank or brassiere 110 is formed using a circular knitted process, band 114 can be incorporated into the blank such that interface 120 between the band and main body 112 is seamless.

As with the first embodiment, cups 122 can be defined in body through a post knitting molding operation, a pleat, an extra course of yarn, and other conventional knitting structures.

Advantageously, the height of band 114 varies along the circumference of blank 110. Accordingly, blank 110 advantageously combines the shaped band benefits available from prior cut-and-sew garments with the seamless band benefits of prior tubular blank garments. Band 114 can be provided with the desired variable height by distorting the fold line of the fabric to allow the edge of the garment to be shaped to a desired profile. The distortion can be produced by a combination of stitch structures and/or stitch sizes. For example, band 114 can include tuck stitches or miss-knit stitches to provide the band with the desired variable height.

Figure 5:
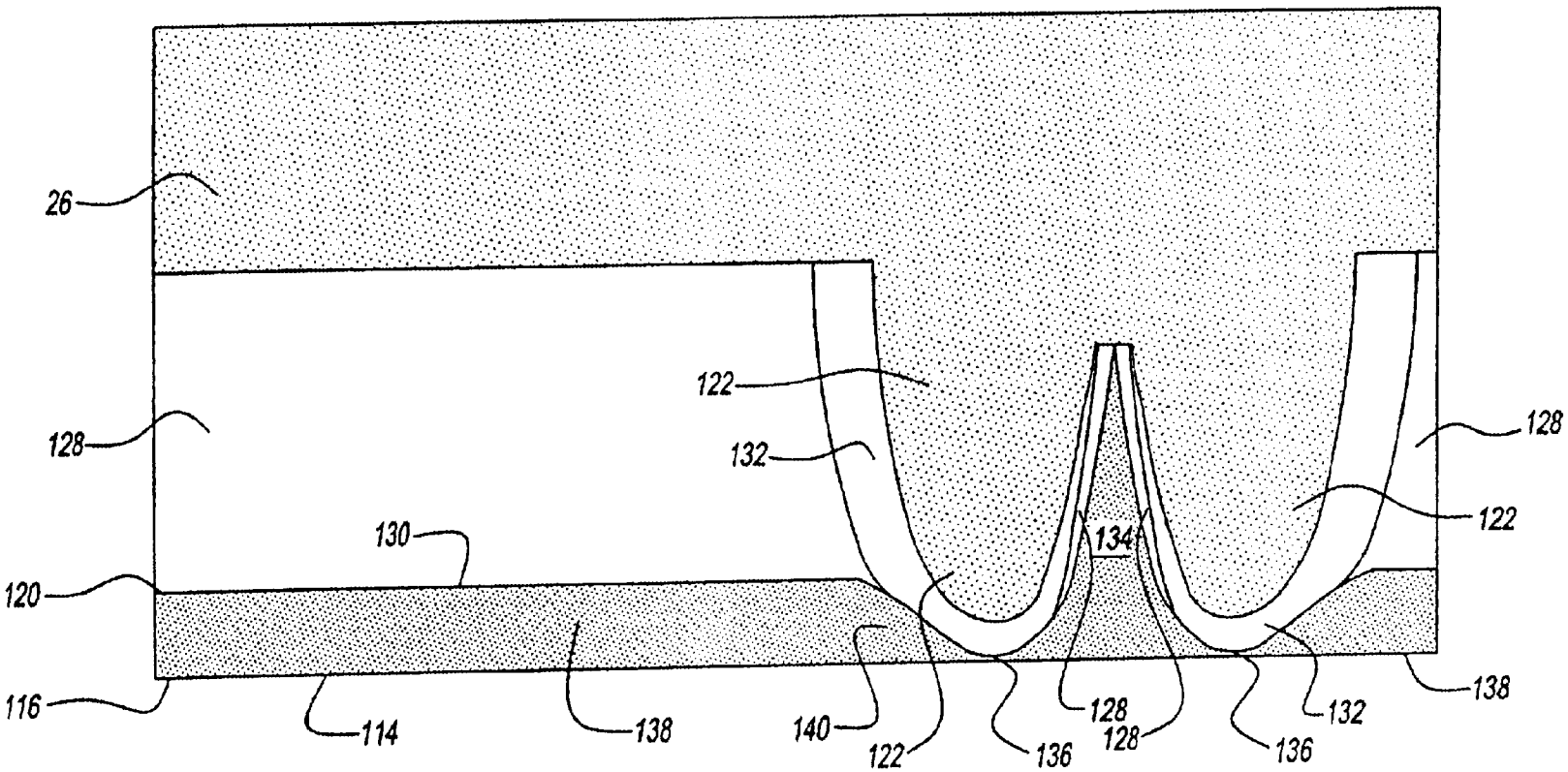
FIG. 5 illustrates a front view of the tubular blank of FIG. 4 laid out along its circumference.
Figure 6:
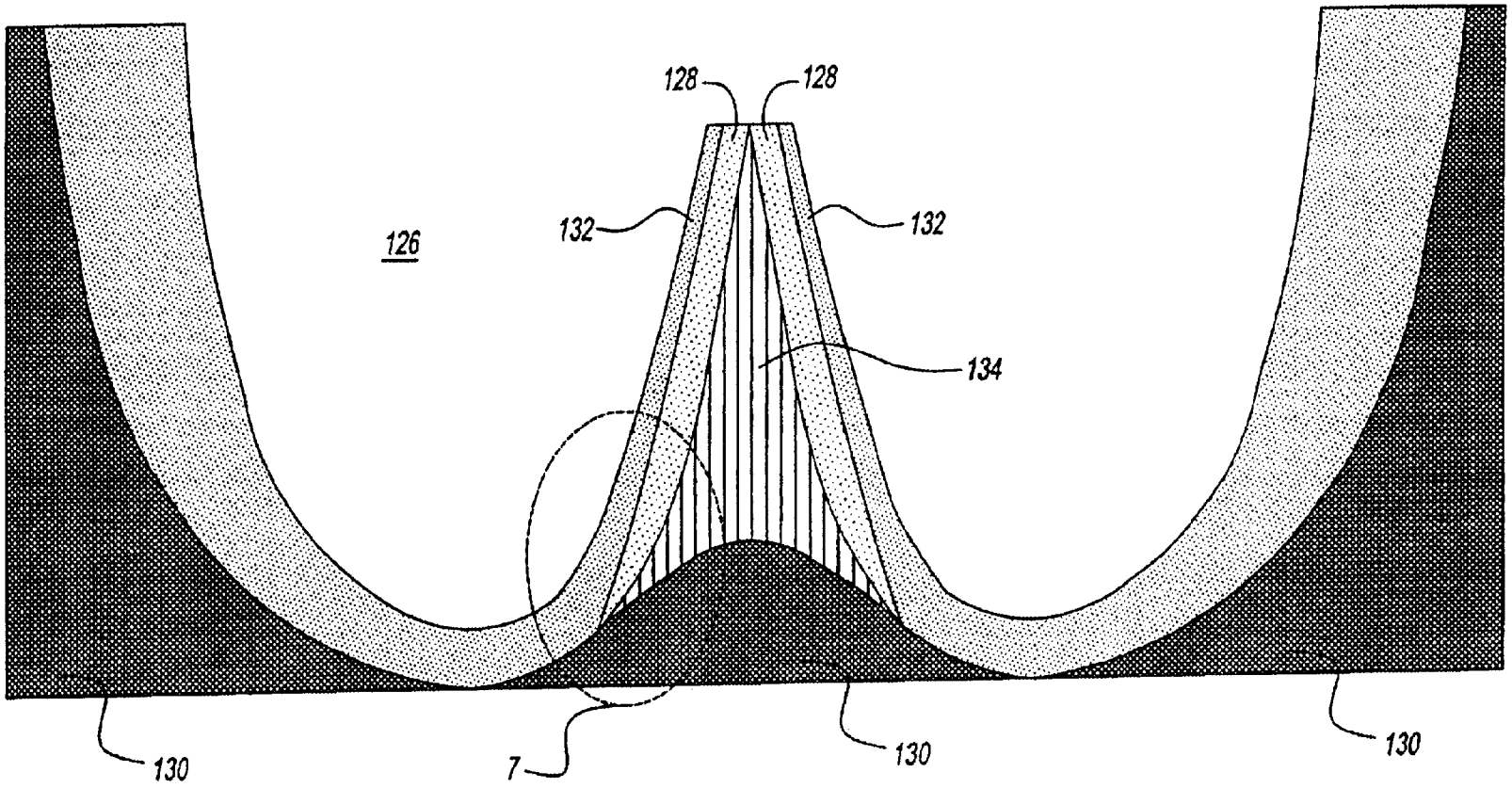
FIG. 6 illustrates a first enlarge view of the tubular blank of FIG. 5.
Figure 7:
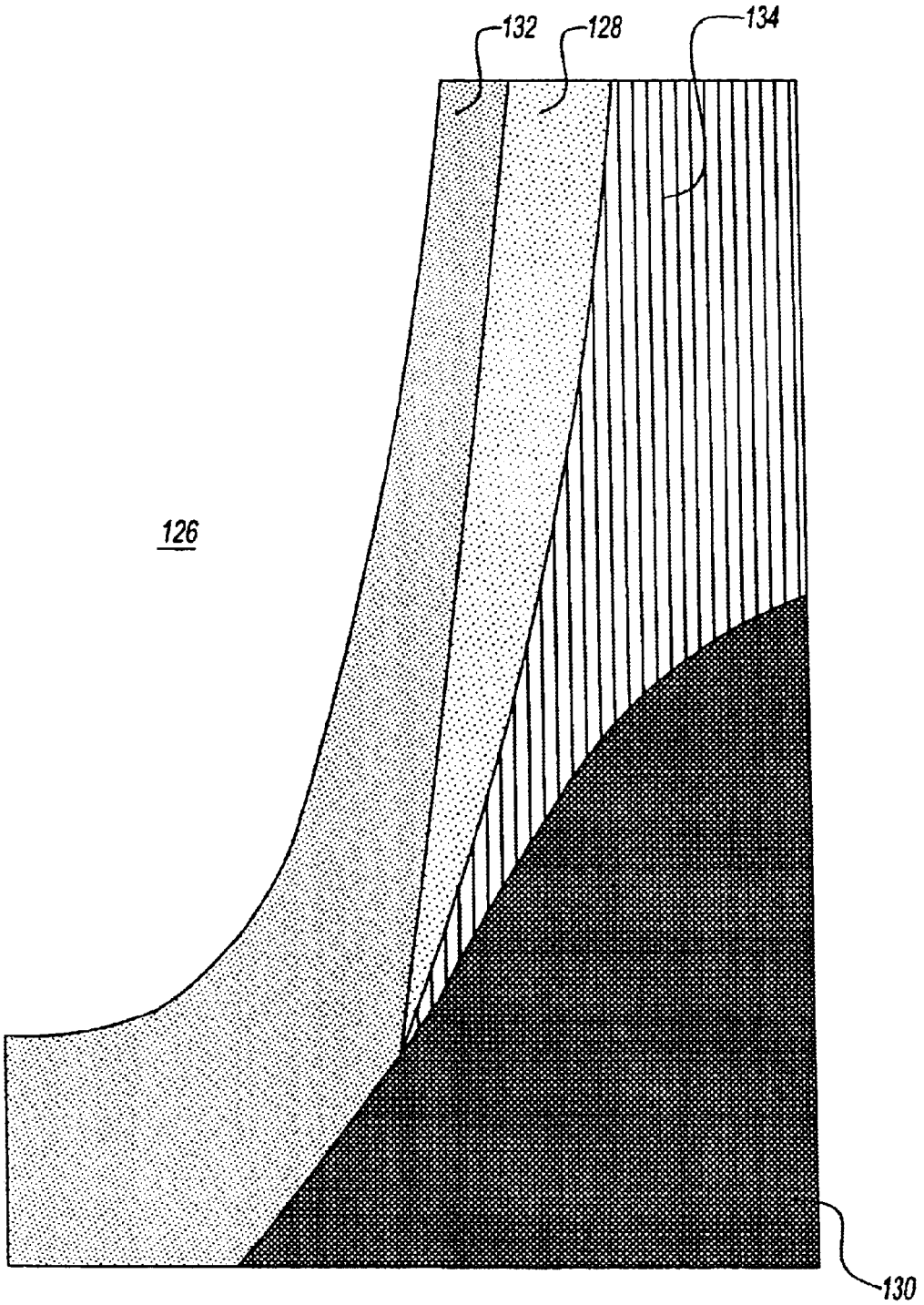
FIG. 7 illustrates an enlarged view of circle 7 in FIG. 6.

Turning now to FIGS. 5 through 7, blank or brassiere 110 having a variable height band 114 is illustrated laid flat along its circumference. Blank 110 comprises a plurality of areas, each having a different stitch structure. By way of example, blank 110 can comprise five areas, namely a first area 126, a second area 128, a third area 130, a fourth area 132, and a fifth area 134.

Band 114 varies among a first height 136, a second height 138, and a transition height 140 by distorting the fold line of the fabric in the third area 130 to allow an interface 120 between the third area and the other areas 128, 132, 134 to be shaped to a desired profile. The distortion can be produced by a combination of stitch structures and/or stitch sizes. For example, band 114 can include tuck stitches or miss-knit stitches to provide the band with the desired variable height.

First area 126 defines the portion of brassiere 110 that traverses around the upper back of the wearer and includes downwardly depending breast cups 122. The stitch structure of first area 126 is plain knit to provide a soft, comfortable feel to the wearer. First area 126 can provide a first level of elasticity. However, first area is preferably inelastic (e.g., the first level of elasticity is inelastic).

Second area 128 defines the portion of the brassiere below first area 126. Second area 128 traverses from one breast cup to the other around the mid-back of the wearer. Further, second area 128 also defines a portion of the space between the breast cups 122. The stitch structure of second area 128 is, preferably, 1-to-1 mesh knit, which provides a minimum depth distortion. Second area 128 has a second level of elasticity that biases breast cups 122 against the body of the wearer. The second level of elasticity has a greater elasticity than that of the first level.

Third area 130 defines band 114 that runs along the circumference of blank 110 at lower edge 116. Third area 130 has a variable height 118 along the circumference. For example, the portion of third area 130 beneath breast cups 122 has a first height 136, while the portions of the third area between the breast cups and around the back of the user have a second, larger height 138. Preferably, third area 130 includes height transition zones 140 for transitioning between first and second heights 136, 138 in the illustrated curved manner. In addition, it is preferred that the curvature of transition zones 140 be substantially similar to the curvature of the periphery of breast cups 122.

The stitch structure of third area 130 is, preferably, a random 1-to-3 mesh, which gives maximum depth distortion to this area. Accordingly, third area 130 provides a third level of elasticity to maintain lower edge 116 of the brassiere against the body of the wearer. The third level of elasticity has a greater elasticity than that of the second level.

Fourth area 132 is defined at the perimeter of breast cups 122 between first and second areas 126, 128. The stitch structure of fourth area 132 is, preferably, 3-to-1 mesh, which provides medium depth distortion. Thus, fourth area 132 provides a fourth level of elasticity to blank 110 sufficient to support the periphery of breast cups 122 when in use. The fourth level has an elasticity that is between the levels of elasticity of the second and third levels provided by the second and third areas, respectively.

Fifth area 134 is defined intermediate breast cups 122 to provide structure to the area between the breast cups. Fifth area 134 has, preferably, a rib knit structure. Accordingly, fifth area 134 has a fifth level of elasticity sufficient to prevent separation of breast cups 122 from one another. The fifth level has an elasticity that is higher than that of the first, second, third, or fourth levels. In addition, the rib knit structure can be sufficient to prevent compression of breast cups 122 towards one another.

Blank or brassiere 110 can be formed of any desired fabric such as, but not limited to, fabrics made from natural fiber (e.g., cotton, silk), fabrics made from manmade fiber (e.g., NYLON, LYCRA), or combinations of the foregoing. Moreover, each area 126, 128, 130, 132, 134 can be made of similar or dissimilar fabrics.

The circular knitted or tubular blank 110 having shaped band 114 is described herein by way of example only as including areas 126, 128, 130, 132, 134. Of course, more or less than five areas are contemplated by the present invention. Also, it is contemplated that the specific stitch structure in these areas can be modified from those discussed above to provide the same or even different shaping effects as those described herein.

Accordingly, the present invention provides a tubular or circular knitted blank having a seamless shaped band. The seamless shaped band can be provided with a band of constant height where portions the breast cups overlap portions of the constant height band. Alternately, the seamless shaped band can be provided with a band of varying heights where a combination of stitch structures and/or stitch sizes is used to provide variable band height. Accordingly, the blank of the present invention advantageously combines the shaped band benefits available from prior cut-and-sew garments with the seamless band benefits of prior tubular blank garments.

It should also be noted that the terms "first", "second", and "third" and the like may be used herein to modify the various elements. These modifiers do not imply a spatial, sequential, or hierarchical order to the modified elements unless specifically stated.

While the present invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A circularly knitted garment comprising:

a body portion having a first area defined in said body portion; and a shaped band being defined in said body portion so that a seamless interface is formed between said body portion and said shaped band, wherein said first portion and said second portion overlap one another and are knitted to one another along an outer periphery of their overlap to form a pocket.

2. A circularly knitted garment comprising:

a body portion having a first area defined in said body portion; and a shaped band being defined in said body portion so that a seamless interface is formed between said body portion and said shaped band, wherein said shaped band has a variable height about a circumference of the circularly knitted garment.

3. The garment of claim 2, wherein said variable height comprises a first height being defined below said first area and a second height being defined in a remaining portion of said shaped band.

4. A tubular garment blank for use as a brassiere, comprising:

a body portion having a pair of breast cups defined therein; and a shaped band being defined in said body portion so that a seamless interface is formed between said body portion and said shaped band, wherein said shaped band has a constant height about a circumference of the tubular garment blank, and a first portion of each of said pair of breast cups overlaps a second portion of said shaped band, and wherein each of said first and second portions are knitted to one another only along an outer periphery of the overlap.

5. A tubular garment blank for use as a brassiere, comprising:

a body portion having a pair of breast cups defined therein; and a shaped band being defined in said body portion so that a seamless interface is formed between said body portion and said shaped band, wherein said shaped band has a variable height about a circumference of the tubular garment blank.

6. The tubular garment blank of claim 5, wherein said variable height comprises a first height defined below each of said pair of breast cups and a second height defined in remaining portions of said shaped band.

7. The tubular garment blank of claim 6, wherein said first height is smaller than said second height.

8. The tubular garment blank of claim 6, further comprising a height transition zone between said first and second heights.

9. A circularly knitted brassiere comprising:

a main body portion;

a shaped band being defined at a lower edge of said main body portion so that a seamless interface is provided between said main body portion and said shaped band, said shaped band having a constant dimension between said lower edge and said seamless interface along a circumference of the brassiere; and a pair of breast cups being defined in said main body portion, each of said pair of breast cups having a first portion that overlaps a second portion of said shaped band, said first and second portions being knitted to one another only at a periphery of said pair of breast cups.

10. The brassiere of claim 9, wherein said first and second portions define a pocket therebetween.

11. The brassiere of claim 10, wherein the brassiere is a strapless brassiere.

12. The brassiere of claim 11, wherein said shaped band retains said lower edge of the brassiere against a body of a wearer when the brassiere is worn.

13. A circularly knitted brassiere comprising:

a main body portion having a first area, a second area, a third area, a fourth area, and a fifth area;

a pair of breast cups being defined in said main body portion; and a shaped band being defined at a lower edge of said main body portion so that a seamless interface is provided between said main body portion and said shaped band, said shaped band having a variable dimension between said lower edge and said interface along a circumference of the brassiere, wherein said first area defines said pair of breast cups and has a plain knit stitch structure that provides a first level of elasticity, and wherein said second area traverses from one of said pair of breast cups to another of said pair of breast cups around a middle back of the wearer during use, said second area having a mesh knit structure providing a second level of elasticity, said second level being greater than said first level.

14. The brassiere of claim 13, wherein said third area defines said shaped band, said third area having a mesh knit structure providing a third level of elasticity, said third level being greater than said second level.

15. The brassiere of claim 14, wherein said fourth area defines a perimeter of said pair of breast cups, said fourth area having a mesh stitch structure providing a fourth level of elasticity, said fourth level being greater than said third level but less than said second level.

16. The brassiere of claim 15, wherein said fifth area is defined intermediate said pair of breast cups and has a rib knit structure, said fifth area having a fifth level of elasticity that is greater than any of said first, second, third, and fourth levels of elasticity.

* * * * *